US006168252B1

(12) United States Patent
Yaji

(10) Patent No.: US 6,168,252 B1
(45) Date of Patent: Jan. 2, 2001

(54) INK JET PRINTER

(75) Inventor: Masao Yaji, Tokyo (JP)

(73) Assignee: Oki Data Corporation, Tokyo (JP)

( * ) Notice: Under 35 U.S.C. 154(b), the term of this patent shall be extended for 0 days.

(21) Appl. No.: 09/162,059

(22) Filed: Sep. 28, 1998

(30) Foreign Application Priority Data

Sep. 29, 1997 (JP) ..... 9-263778

(51) Int. Cl.[7] ..... B41J 29/38

(52) U.S. Cl. ..... 347/14; 347/14; 347/19; 201/1

(58) Field of Search ..... 347/14, 19, 17, 347/18; 201/1; 374/141, 184

(56) References Cited

U.S. PATENT DOCUMENTS 4,614,567 * 9/1986 Stahlherm et al. ..... 201/1
6,050,665 * 4/2000 Kishi ..... 347/14
6,062,668 * 5/2000 Cruz-Uribe ..... 347/19

* cited by examiner

*Primary Examiner*—John Barlow
*Assistant Examiner*—Cesar G. Lago
(74) *Attorney, Agent, or Firm*—Akin, Gump, Strauss, Hauer & Feld, L.L.P.

(57) ABSTRACT

An ink jet printer has a printhead formed of a piezoelectric element having an electrical capacitance with a known temperature characteristic. A memory stores a reference temperature Tref and a reference capacitance Cref of the printhead measured at the reference temperature. A capacitance measuring section measures a capacitance Cm of the printhead at a temperature Te when the printer is in use. A temperature computing section computes the temperature Te on the basis of the reference capacitance Cref, the measured capacitance value Cm, and the reference temperature Tref. A table lists various values of the temperatures and corresponding values of the drive voltages. An optimum value is selected from among the values of the drive voltage listed in the table and is used for driving the printhead at the selected temperature.

5 Claims, 10 Drawing Sheets

INK JET PRINTER

BACKGROUND OF THE INVENTION

1. Field of the Invention

The present invention relates to an ink jet printer having a printhead where when a piezoelectric element receives a drive voltage, the piezoelectric element is deformed to eject ink drops.

2. Description of the Related Art

Conventional ink jet printers suffer from a problem that the properties of the ink such as viscosity change with environmental changes. Changes in ink property cause poor print quality. Viscosity of ink is high at low temperatures, causing smaller ink drops. Conversely, viscosity is low at higher temperatures, causing larger ink drops.

At the same temperature, lower drive voltages cause smaller shear mode deformation of the piezoelectric element, resulting in lower pressures in the ink pressure chamber formed of the piezoelectric element. As a result, ink drops ejected from the ink chamber are small. Conversely, higher drive voltages cause larger shear mode deformation of the piezoelectric element, resulting in higher pressures in the pressure chamber. The higher pressures cause larger ink drops.

Therefore, variations in the size of ink drop due to temperature variations can be compensated for by increasing the drive voltage when the temperature is relatively low, and decreasing when the temperature is relatively high.

With some conventional printers, the temperatures of environment, printhead, or ink are measured and the drive conditions of the printhead are controlled in accordance with the measured temperature, thereby maintaining the same print quality. If a printhead is formed of a piezoelectric material whose dielectric constant is a function of temperature, the temperature of the printhead can be determined in terms of capacitance. Then, drive conditions are adjusted in accordance with the property of ink at the measured temperature. This way of temperature compensation is effective since the capacitance of the piezoelectric element is substantially proportional to the temperature.

However, even at the same temperature, the capacitance value of the piezoelectric element may vary from printhead to printhead. Different capacitances are interpreted as different temperatures of the printheads. Thus, if the drive conditions of the printhead are to be adjusted in accordance with the capacitance of the printhead, the printheads are driven under different drive conditions at the same temperature. Thus, ejected ink drops are of different sizes, causing poor print quality.

SUMMARY OF THE INVENTION

An object of the invention is to provide a printer having a printhead which ejects ink drops of the same size regardless of the temperature of the printhead.

Another object of the invention is to provide a printer having a printhead which ejects ink drops of the same size regardless of changes in the viscosity of ink with temperature.

An ink jet printer has a printhead formed of a piezoelectric element having a capacitance whose value is a function of the temperature of the printhead. The piezoelectric element is deformed to eject ink drops from the printhead in accordance with drive voltages applied to the piezoelectric element.

A memory stores a reference temperature Tref of the printhead and a reference capacitance Cref of the printhead measured at the reference temperature Tref.

A capacitance measuring section measures a value Cm of the capacitance of the printhead at a value Te of the temperature of the printhead. A temperature computing section 22 computes the first value Te of the temperature on the basis of the reference capacitance Cref, the temperature Tref, and the measured second capacitance value Cm. A temperature-drive voltage table lists values of the temperature Te and corresponding values of the drive voltages. A voltage selecting section selects an optimum value of drive voltage from among the values of the drive voltage listed in the temperature-voltage table. The optimum value is a value corresponding to a temperature which is the closest to the computed temperature. The optimum value is used to drive the printhead.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
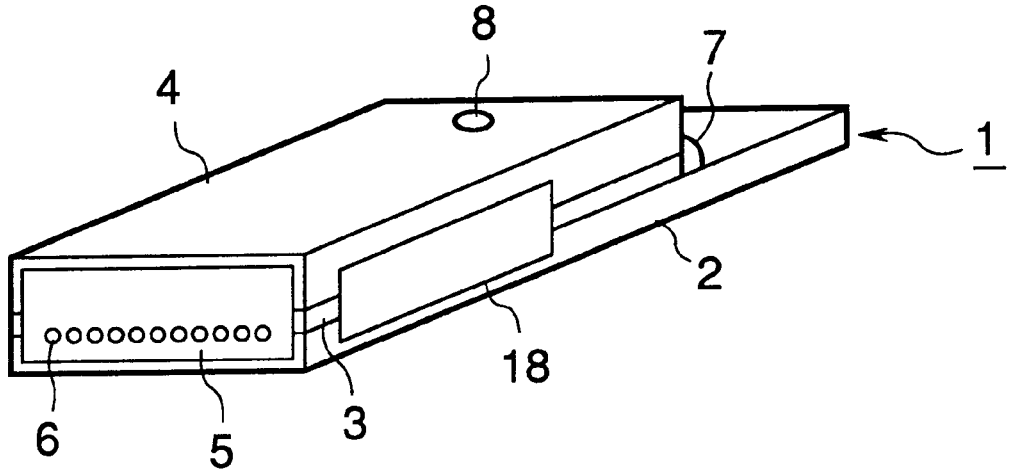
FIG. 1 is a perspective view of a printhead for use in the ink jet printer of the invention.

Embodiments of the invention will be described with reference to the accompanying drawings. Like elements have been given like reference numerals.

First Embodiment

The construction of the printhead will be described with reference to the figures.

FIG. 1 is a perspective view of a printhead for use in an ink jet printer of the present invention. Referring to FIG. 1, the printhead 1 includes a top plate 4, a bottom plate 2, and an intermediate plate 3 sandwiched between the top plate 4 and the bottom plate 2. The printhead 1 is closed at its front end by an orifice plate 5 which is bonded thereto. The orifice plate 5 has a plurality of orifices 6 formed therein so that ink pressure chambers of the printhead ejects ink drops through a corresponding orifice. The orifices 6 are formed in line. The printhead 1 is closed at its rear end by a sealing material 7. The top plate 4 is provided with an ink filling hole 8 therein through which ink is replenished to the respective ink pressure chambers from an external ink tank.

Figure 2:
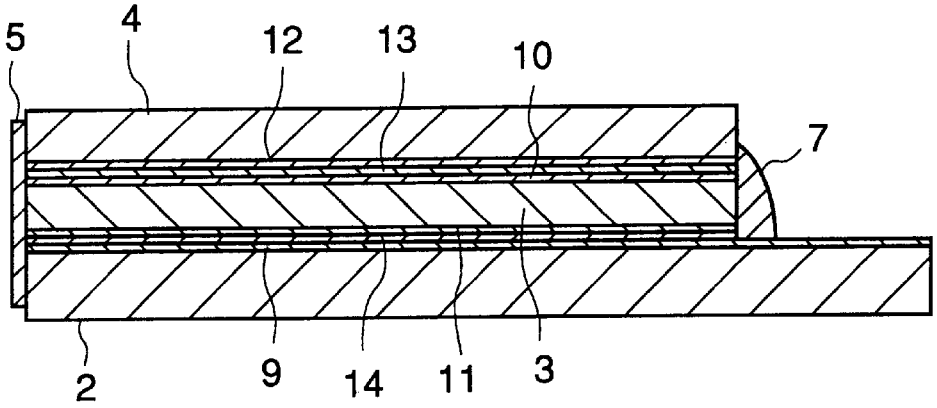
FIG. 2 is a cross-sectional side view of the printhead.

FIG. 2 is a cross-sectional side view of the printhead 1. Referring to FIG. 2, the bottom plate 2 has an electrode 9 and the intermediate plate 3 has electrodes 10 and 11 on its upper end and lower end, respectively. The bottom plate 2 and intermediate plate 3 are formed of a piezoelectric material having a capacitance whose value is a function of temperature. The top plate 4 has a common electrode 12 on its underside. The bottom plate 2, intermediate plate 3, and top plate 4 are placed one on top of the other and bonded together by an electrically conductive adhesive at 13 between the electrodes 12 and 10, and 14 between the electrodes 11 and 9.

Figure 3:
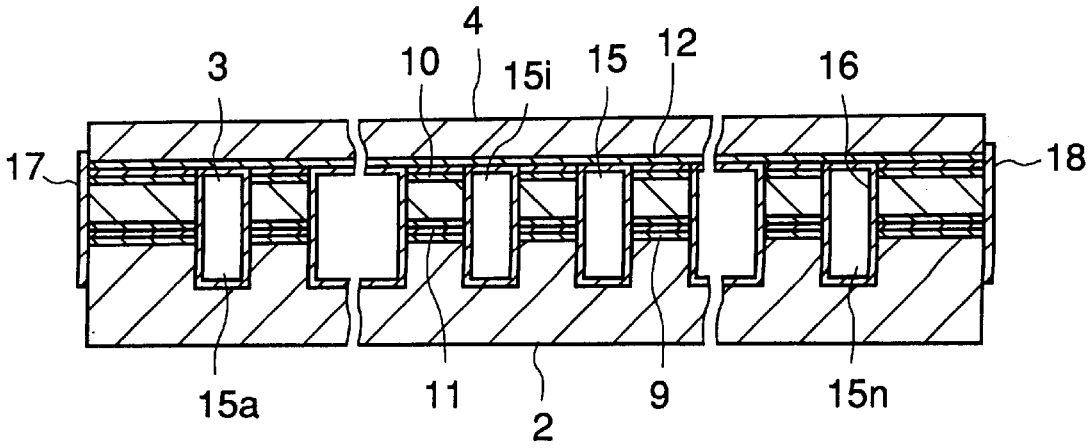
FIG. 3 is a cross-sectional view of the front side view of the printhead.
Figure 10:
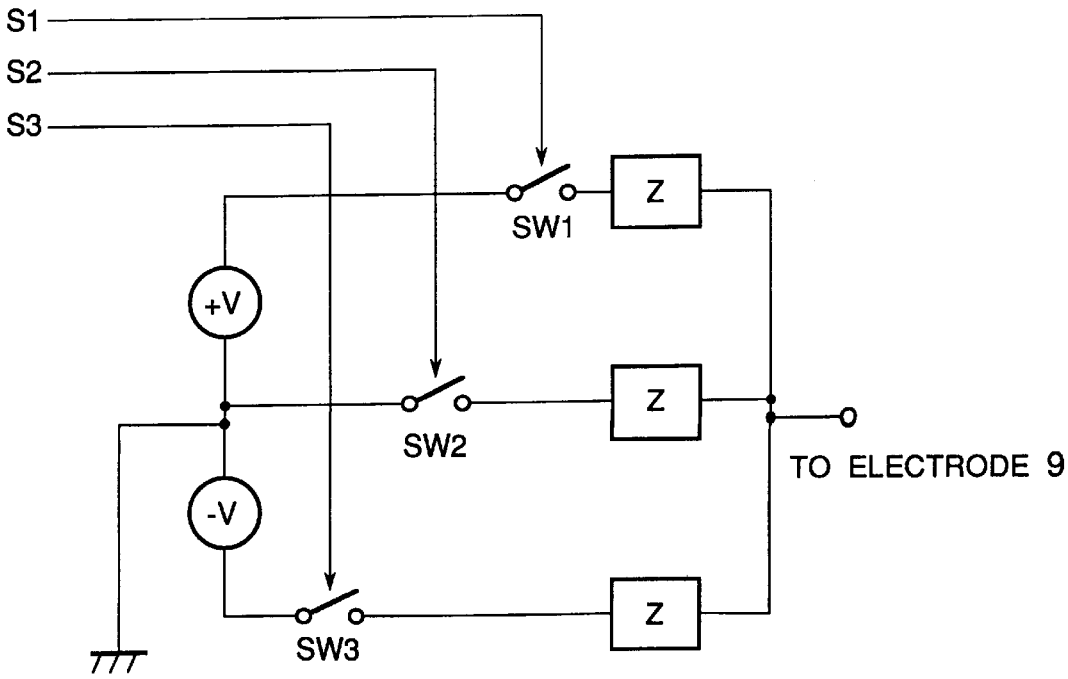
FIG. 10 is a block diagram illustrating a drive circuit 27 that switches drive voltages applied to the printhead.

FIG. 3 is a cross-sectional front view of the printhead 1. Referring to FIG. 3, ink pressure chambers 15*a*–15*n* are spaces defined by the intermediate plate 3, top plate 4, and bottom plate 2, and each of the ink pressure chambers 15*a*–15*n* has a corresponding orifice 6. The ink pressure chambers 15*a*–15*n* communicate with the ink filling hole 8 formed in the top plate 4 and therefore the ink pressure chambers 15*a*–15*n* are supplied with ink at all times. The common electrode 12 on the underside of the top plate 4 is electrically continuous with the electrodes 9 on the bottom plate 2 via electrically conductive adhesives 17 and 18 on the left and right sides of the printhead 1, respectively. The common electrode 12 is connected to the ground electrode of a drive circuit (FIG. 10).

Figure 4:
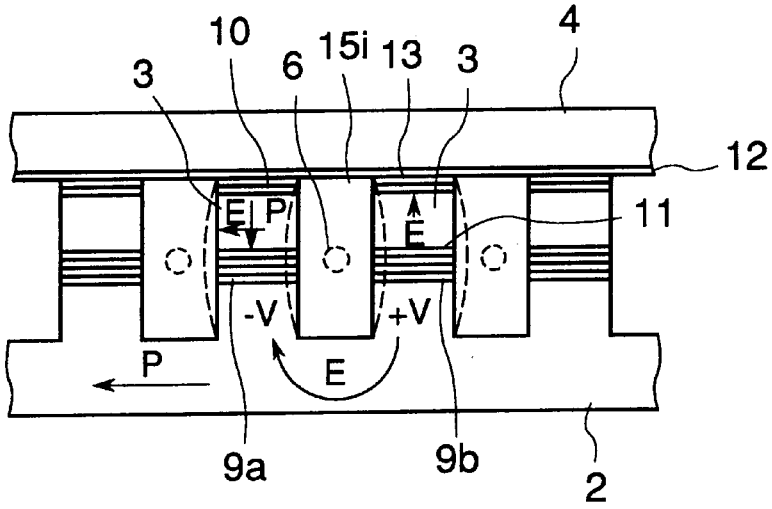
FIGS. 4 and 5 are front views of the printhead with the orifice plate removed, illustrating the ink-ejecting operation of the printhead.
Figure 5:
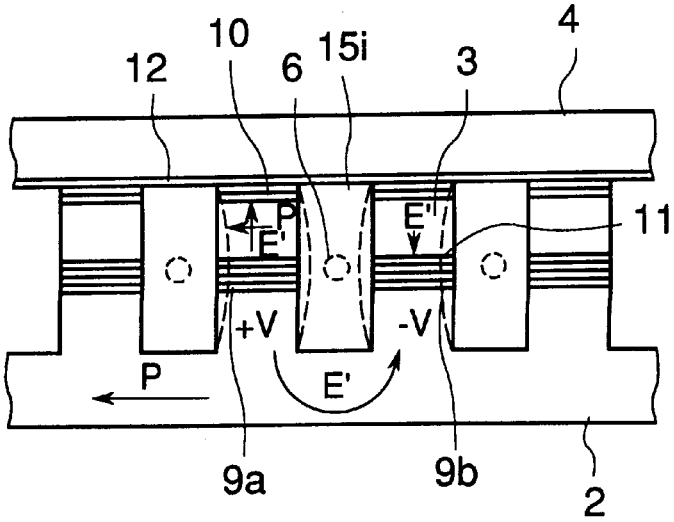

FIGS. 4 and 5 are front views of the printhead 1 with the orifice plate 5 removed, illustrating the ink-ejecting operation of the printhead 1. The ink-ejecting operation of the printhead 1 will be described by way of the ink pressure chamber 15*i* with reference to FIGS. 4 and 5.

The bottom plate 2 and the intermediate plate 3 are polarized in a direction shown by arrow P. When the common electrode receives a voltage of zero volts, and the electrodes 9*a* and 9*b* receive negative and positive voltages, respectively, electric fields are developed in directions shown by arrows E (FIG. 4) in the intermediate plate 3 and bottom plate 2. The electric fields cause the bottom plate 2 and intermediate plate 3 to deform in the shear mode into shapes shown by dotted lines. This deformation causes the volume of the ink pressure chamber 15*i* to increase, receiving ink from the external ink tank through the ink filling hole 8.

When the common electrode 12 receives a voltage of zero volts, and the electrodes 9*a* and 9*b* receive positive and negative voltages, respectively, electric fields are developed in directions shown by arrows E' (FIG. 5) in the intermediate plate 3 and bottom plate 2. The electric fields cause the bottom plate 2 and intermediate plate 3 to deform in the shear mode into shapes shown by dotted lines. This deformation is opposite to that shown in FIG. 4 and causes the volume of the ink pressure chamber 15*i* to decrease, so that the ink pressure chamber 15*i* ejects an ink drop through the orifice 6.

Figure 6:
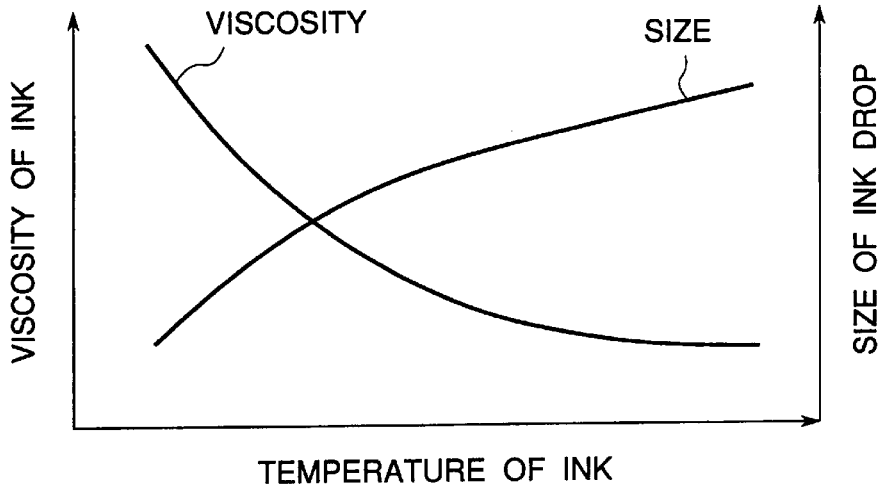
FIG. 6 is a graph showing the relationship between the temperature and the viscosity of the ink, and the relationship between the temperature and the volume of ink drop.

FIG. 6 is a graph showing the relationship between the temperature of ink and the viscosity of the ink, and the relationship between the temperature of ink and the volume of ink drop. As shown in FIG. 6, the ink viscosity decreases with increasing temperature. The volume or size of an ink drop increases with increasing temperature.

Figure 7:
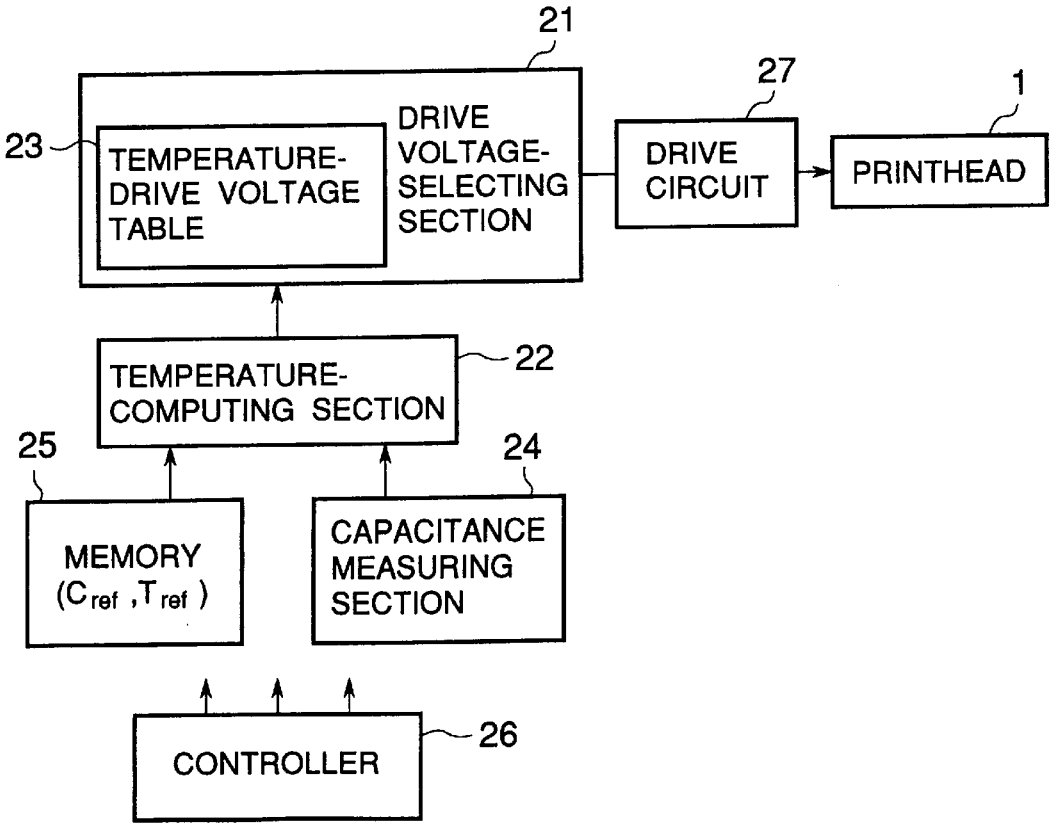
FIG. 7 is a block diagram illustrating an ink jet printer according to a first embodiment.

FIG. 7 is a block diagram illustrating an ink jet printer according to a first embodiment.

There are provided a capacitance measuring section 24, a memory 25, a temperature computing section 22, a drive circuit 27, and a drive voltage selecting section 21, which are controlled by a controller 26. The capacitance measuring section 24 measures a capacitance Cref of the printhead 1 at a reference temperature Tref during the manufacture. The capacitance measuring section 24 also measures a capacitance Cm of the printhead at a temperature Te when the printhead is in use. The memory 25 stores the reference capacitance Cref and the reference temperature Tref therein. When computing a temperature when the printhead is in use, the temperature computing section 22 receives the capacitance value Cm from the capacitance measuring section 24 and the reference capacitance Cref and temperature Tref from the memory 25. The temperature computing section 22 then computes a temperature of the printhead on the basis of the Cm, Cref, and Tref.

Figure 8:
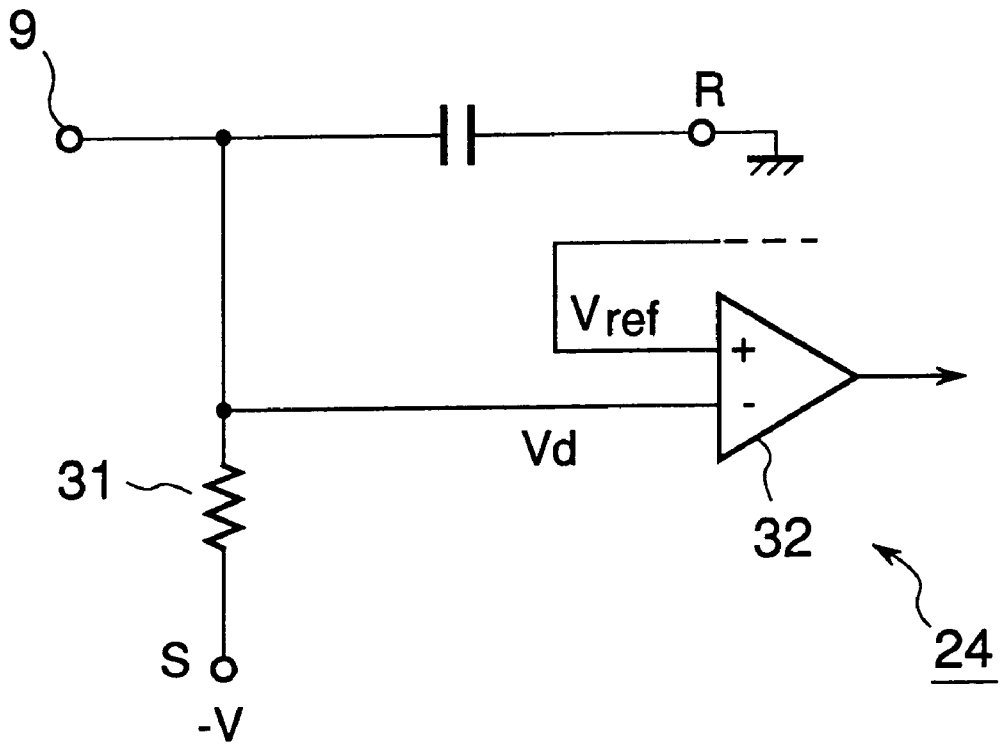
FIG. 8 is a schematic diagram showing the construction of the capacitance measuring section 24.

FIG. 8 is a schematic diagram showing the construction of the capacitance measuring section 24. A comparator 32 has a negative input connected to a resistor 31, and a positive input connected to a reference voltage Vref. The negative input is also connected to the electrode 9 of the printhead 1. The capacitance of the printhead 1 exists between the electrode 9 and a terminal R connected to the ground, not shown. The resistor 31 is connected to a terminal S which in turn is connected to a negative voltage source −V. The comparator 32 receives a detection voltage Vd appearing on the electrode 9, compares the detection voltage Vd with the reference voltage Vref, and outputs a signal to the temperature computing section 22 when the detection voltage Vd exceeds the reference voltage Vref. After the application of the voltage −V to the terminal S, the detection voltage Vd changes from zero volts to −V with a time constant determined by the resistor 31 and the capacitance between the electrode 9 and the terminal R. In other words, the capacitance measuring section 24 measures the capacitance of the printhead formed between the electrode 9 and the terminal R connected to the ground.

Figure 9:
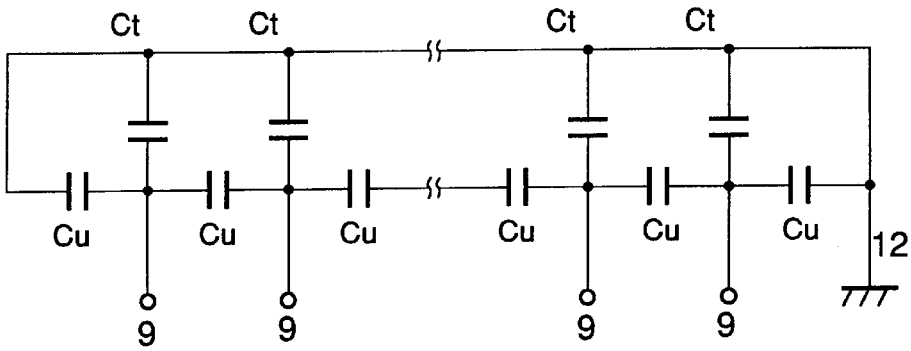
FIG. 9 is a schematic diagram showing an electrical equivalent circuit of the printhead according to the embodiment.

FIG. 9 is a schematic diagram showing an electrical equivalent circuit of the printhead according to the first embodiment. Referring to FIG. 9, Ct represents a capacitance between the common electrode 12 and each of electrodes 9*a*, 9*b*, . . . and so on, and Cu indicates a capacitance between adjacent electrodes 9*a*, 9*b*, . . . and so on. Thus, the total capacitance of the printhead is determined by the combination of the capacitances Ct and Cu. However, the capacitance Cu is much smaller than the capacitance Ct since the electrode 9 (e.g., 9*a*) is farther away from its adjacent electrode (e.g., 9*b*) than from the common electrode 12. Therefore, the value of Cu can be neglected.

FIG. 10 is a block diagram illustrating a drive circuit 27 that switches drive voltages applied to the printhead. There are provided as many drive circuits 27 as there are electrodes 9. The drive circuit 27 drives the printhead 1 in accordance with the print data. The drive circuit 27 is also used to output a negative voltage −V when measuring the capacitance (Cm and Cref) of the printhead 1.

When a switch SW1 is closed and both switches SW2 and SW3 are opened, the drive circuit 27 outputs a voltage +V via an impedance element Z. When the switch SW2 is closed and both the switches SW1 and SW3 are opened, the drive circuit 27 outputs a voltage of zero volts via an impedance element Z. When the switch SW3 is closed and both the switches SW1 and SW2 are opened, the drive circuit 27 outputs a voltage −V via an impedance element Z.

Figure 11:
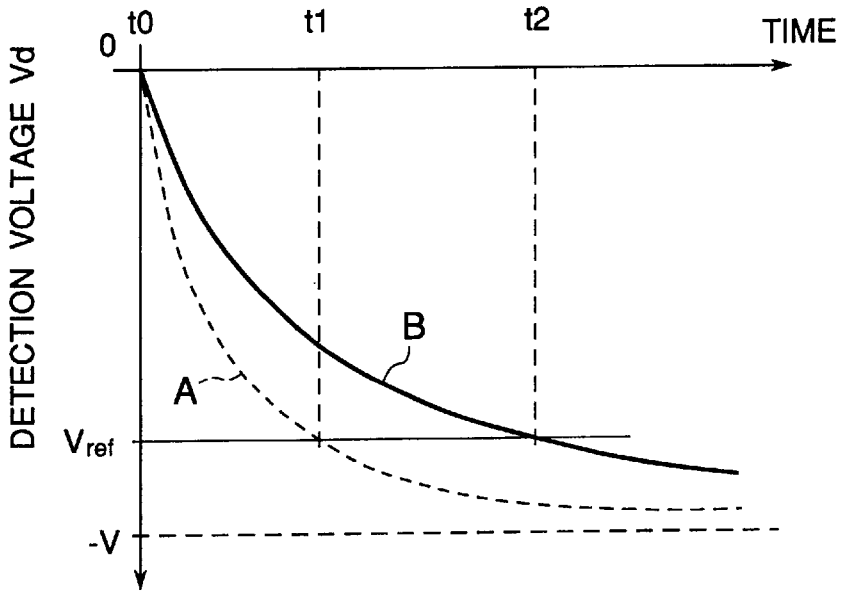
FIG. 11 illustrates the changes in detection voltage V1 with time.

FIG. 11 illustrates changes in detection voltage Vd with time. The operation of the drive circuit 27 will be described with reference to FIGS. 10 and 11.

Prior to the measurement of the capacitance of the printhead 1, the switches SW1 and SW3 are opened and the switch SW2 is closed so that the electrodes 9 receive 0 volts and therefore the bottom plate 2 and intermediate plate 3 are not deformed. Then, the switche SW2 is opened, thereby applying high impedance. When the switch SW2 is opened at time t0 (FIG. 11), the detection voltage Vd, i.e., the voltage appearing on the electrode voltage decreases from zero volts toward the voltage −V exponentially according to the time constant defined by the resistor 31 and the capacitance of the printhead 1. The detection voltage Vd negatively decreases and eventually passes the reference voltage Vref. The time required for the detection voltage Vd to pass the reference voltage Vref varies depending on the capacitance value of the printhead 1. In other words, the capacitance of the printhead 1 can be determined by measuring the time from the application of the high impedance till the detection voltage Vd passes the reference voltage Vref.

Referring to FIG. 11, Curve A (dotted line) shows the changes of the detection voltage Vd when the capacitance of the printhead 1 is relatively small while Curve B (solid line) shows the changes of the detection voltage Vd when the capacitance of the printhead 1 is relatively large.

When the detection voltage Vd has decreased below the reference voltage Vref, the comparator 32 outputs a signal of, for example, a logic "1." The time from t0 till the comparator 32 outputs a logic "1" at time t1 or t2 is measured, thereby determining the capacitance of the printhead.

The operation of the first embodiment will be described.

Referring again to FIG. 1, the memory 25 stores the reference capacitance Cref of the printhead 1 measured during the manufacture and the reference temperature Tref of the printhead 1 at which the reference capacitance Cref was measured.

The controller 26 incorporates a program that outputs two commands: the first is a command for causing the capacitance measuring section 24 to measure the capacitance Cm of the printhead 1 when the print head is in use, and the second is a command for causing the temperature computing section 22 to compute the temperature of the printhead 1 which is actually used. On the basis of the Cref, Tref, and the measured capacitance Cm, the temperature computing section 22 computes the temperature Te of the printhead which is in use. The CPU of the controller 26 executes the program.

Upon the command, the capacitance measuring section 24 measures the capacitance Cm of the printhead 1 and outputs the value of the capacitance Cm to the temperature computing section 22. The controller 26 causes the memory 26 to output the reference capacitance Cref and the reference temperature Tref to the temperature computing section 22.

The temperature computing section 22 determines a temperature Te of the printhead by the following equation.

$$Te=Tref+(Cm-Cref)\times\alpha$$

where α is a temperature coefficient and is substantially constant if the composition of the piezoelectric material is the same.

The computed temperature Te is output to the drive voltage section 21. The drive voltage section 21 has a temperature-drive voltage table 23 which lists drive voltages (+V and −V) for various temperatures. The drive voltage selecting section 21 selects drive voltages (+V and −V) corresponding to a temperature which is the closest to the computed temperature Te from the table 23 optimum, and outputs the drive voltages to the printhead 1.

Figure 12:
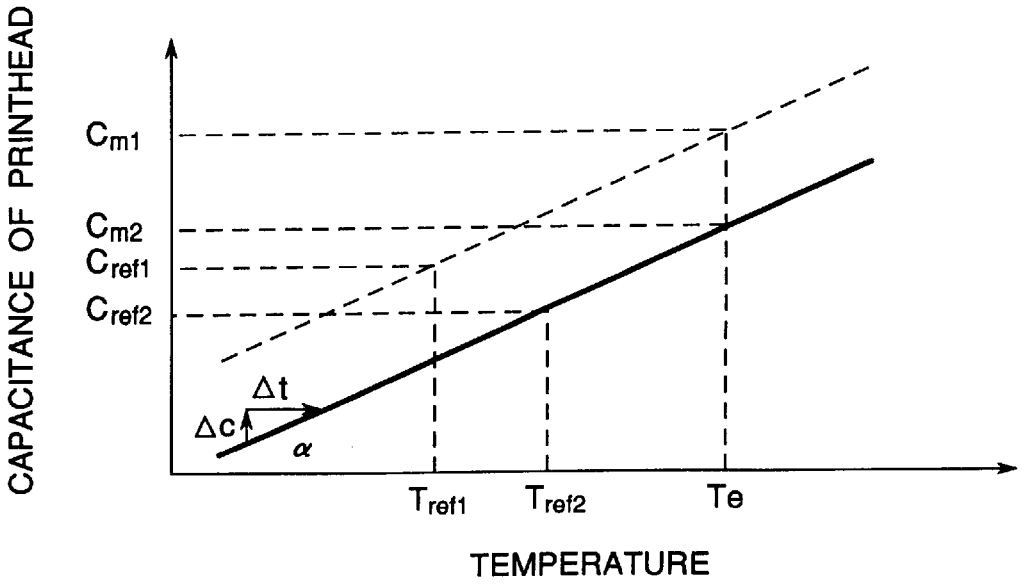
FIG. 12 illustrates the temperature characteristic of the capacitance of the printhead.

FIG. 12 illustrates the temperature characteristic of the capacitance of the printhead 1. The temperature coefficient α will be described in more detail with reference to FIG. 12.

FIG. 12 shows temperature-capacitance characteristics for two printheads of the same design. The difference in characteristic is due to manufacturing variations such as the thickness of the electrically conductive adhesives 13 and 14 and the dimensional variations of the ink pressure chambers. The dotted line curve and solid line curve show different capacitance values for the same temperature. However, it is to be noted that the slope of the two curves are substantially the same. The temperature coefficient α is the reciprocal of the slope, i.e., Δt/Δc. The value of α can be determined previously. Thus, using the reference capacitance Cref, reference temperature Tref, and the temperature coefficient α, the temperature Te in which the printhead is actually used can be computed.

The temperatures Te for the dotted line curve and solid line curve are computed as follows.

$$Te=Tref1+(Cm1-Cref1)\times\alpha, \text{ for the dotted line curve.}$$

$$Te=Tref2+(Cm2-Cref2)\times\alpha, \text{ for the solid line curve.}$$

In this manner, a temperature Te can be accurately determined so that the printhead 1 can be driven with proper drive voltages (+V and −V).

Modification of the First Embodiment

Figure 13:
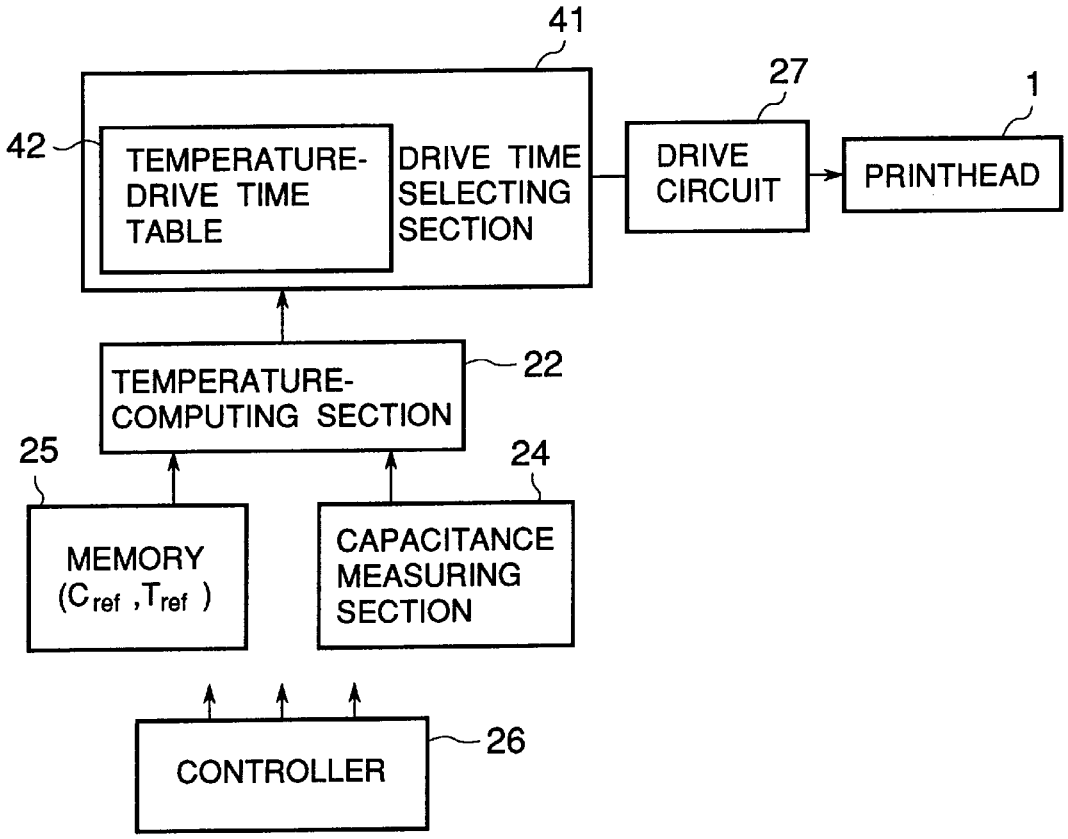
FIG. 13 is a block diagram showing a modification of the first embodiment.

FIG. 13 is a block diagram showing a modification of the first embodiment. The feature of the modification is that the length of time for which the drive voltages are applied to the printhead 1 is varied in accordance with the temperature Te.

The modification differs from the first embodiment in that a drive time selecting section 41 is used in place of the drive voltage selecting section 21 and a temperature-drive time table 42 is provided in the drive time selecting section 41. The temperature-drive time table 42 stores lengths of time for which the drive voltages are applied to the printhead 1 at various temperatures Te. The rest of the construction is the same as the first embodiment. The temperature Te is computed in the same way as the first embodiment. The present invention can be applied not only to apparatuses whose drive voltage is selected in accordance with the temperature, but also to apparatuses whose drive voltage is selectively changed.

Second Embodiment

Figure 14:
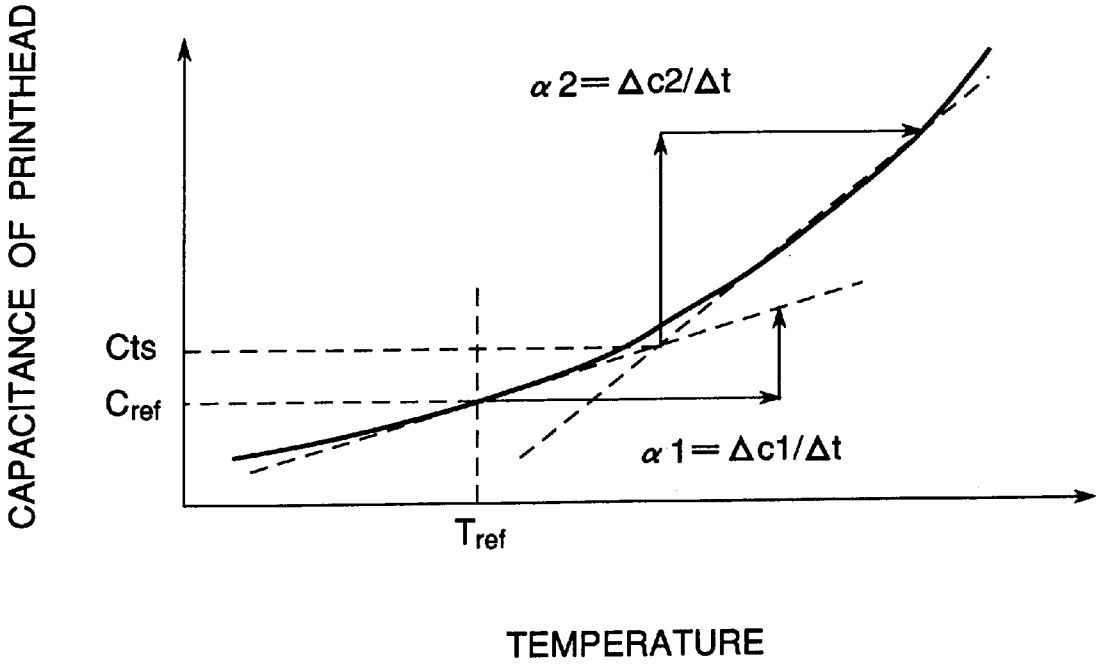
FIG. 14 illustrates the temperature characteristic of the capacitance of the printhead 1.

FIG. 14 illustrates the temperature characteristic of capacitance of the printhead 1 according to a second embodiment. It is to be noted that the capacitance of the printhead 1 of the second embodiment does not change linearly with temperature. With this kind of printhead 1, a computed temperature Te will have a large error if the temperature Te is calculated by using a temperature coefficient of a fixed value.

Therefore, in the second embodiment, the temperature characteristic curve of the capacitance of the printhead is divided into a plurality of portions. In other words, different temperature coefficients of the capacitance are set for different portions of the temperature characteristic curve of the capacitance of the printhead 1, so that the temperature coefficients are selectively used in computing a temperature Te depending on where of the temperature characteristic curve the measured capacitance Cm lies. The curve shown in FIG. 14 may be approximated into, for example, two straight lines (dotted lines) by using a temperature coefficient $\alpha 1=\Delta c1/\Delta t$ for the capacitance smaller than Cts and a temperature coefficient $\alpha 2=\Delta c2/\Delta t$ for the capacitances larger than Cts.

When $Cm \leqq Cts$, then a temperature Te is computed as follows:

$$Te=Tref+(Cm-Cref)/(\Delta c1/\Delta t)$$

When $Cm>Cts$, then a temperature Te is computed as follows:

$$Te=Tref+(Cts-Cref)/(\Delta c1/\Delta t)+(Cm-Cts)/(\Delta c2/\Delta t)$$

Figure 15:
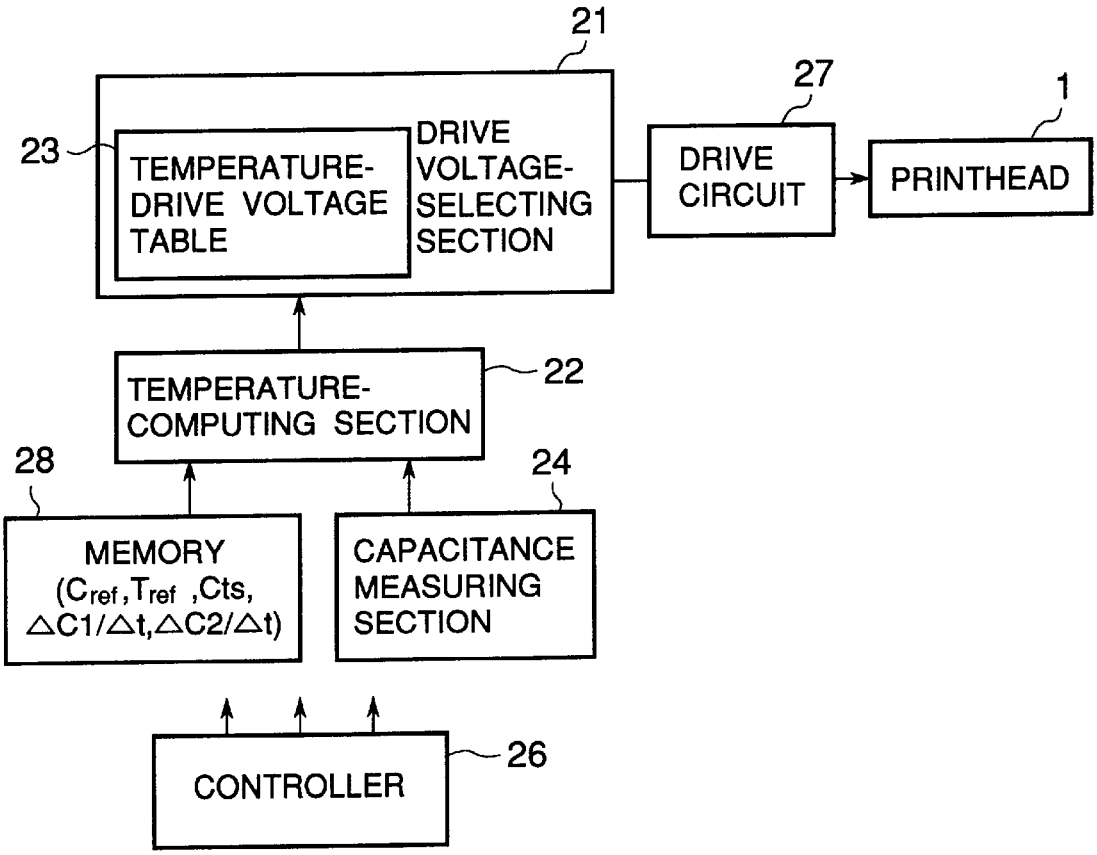
FIG. 15 is a block diagram illustrating an ink jet printer according to a second embodiment.

FIG. 15 is a block diagram illustrating an ink jet printer according to the second embodiment. A memory 28 stores the first and second temperature coefficients ($\alpha 1=\Delta c1/\Delta t$, $\alpha 2=\Delta c2/\Delta t$), a reference capacitance Cref of the printhead 1, a reference temperature Tref at which the reference capacitance Cref was measured during the manufacture in the factory, and a capacitance Cts at which the two straight lines in FIG. 14 are connected. The rest of the construction is the same as that of the first embodiment.

The operation of the second embodiment will be described.

The controller 26 incorporates a program that outputs two commands; the first is a command for causing the capacitance measuring section 24 to measure the capacitance Cm of the printhead 1 when the printhead is in use, and the second is a command for causing the temperature computing section 22 to compute a temperature Te at which the capacitance Cm is measured. The CPU of the controller 26 executes the program.

Upon the command, the capacitance measuring section 24 measures the capacitance Cm of the printhead 1 at a temperature Te just as in the first embodiment. The measured capacitance Cm is then output to the temperature computing section 22. The controller 26 causes the memory 25 to output the Cref, Tref, and Cts, $\Delta c1/\Delta t$, and $\Delta c2/\Delta t$ to the temperature computing section 22.

The temperature computing section 22 comprises the temperature Te on the basis of the Cref, Tref, Cts, $\Delta c1/\Delta t$, $\Delta c2/\Delta t$, and Cm, and subsequently outputs the computed temperature Te to the drive voltage selecting section 21. The drive voltage selecting section 21 has a temperature-drive voltage table 23 which lists optimum drive voltages for various temperatures. The drive voltage selecting section 21 selects optimum drive voltages (+V, −V) corresponding to a temperature which is the closest to the computed temperature Te and outputs the selected drive voltages to the printhead 1.

While the above-mentioned embodiment has been described with respect to two different temperature coefficients $\alpha 1$ and $\alpha 2$, the capacitance curve of the printhead may be divided into more than two portions so that more than two coefficients may be employed for more precise, accurate computation of the temperature Te.

Modification of the Second Embodiment

The second embodiment may be modified in such a way that a drive time selecting section, such as that shown in FIG. 3, including a temperature-drive time table is used in place of the drive voltage selecting section 21. Then, the time for which the drive voltage is applied to the printhead may be changed in accordance with the temperature Te.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet printer having a printhead formed of a piezoelectric element, the piezoelectric element being deformed to eject ink drops from the printhead in accordance with drive voltages applied to the piezoelectric element, the printer comprising:

a capacitance measuring section, measuring a value of a capacitance of the printhead at a value of a temperature;

a memory, storing a reference value of the temperature and a reference value of the capacitance of the printhead measured at the reference value of the temperature;

a temperature computing section, computing the value of the temperature on the basis of the reference value of the capacitance, the reference value of the temperature, and the value of the capacitance;

a table which lists a plurality of values of the temperature and values of the drive voltage corresponding to the plurality of values of the temperature; and a voltage selecting section, selecting a value of the drive voltage from among the values of the drive voltage listed in said table, the value of the drive voltage corresponding to a temperature closest to the value of the temperature and being used for driving the printhead at the value of the temperature.

2. The ink jet printer according to claim 1, wherein the capacitance of the printhead has a predetermined temperature coefficient and said temperature computing section computes the value of the temperature using the temperature coefficient.

3. The ink jet printer according to claim 1, wherein there are a plurality of ranges of the temperature, and the capacitance has different temperature coefficients in the plurality of ranges of the temperature.

4. The ink jet printer according to claim 1, wherein the reference value of the capacitance and the reference value of the temperature are measured during manufacture of the printhead, and the value of the capacitance is measured during use of the printhead.

5. An ink jet printer having a printhead formed of a piezoelectric element, the piezoelectric element being deformed to eject ink drops from the printhead in accordance with drive voltages applied to the piezoelectric element, the printer comprising:

a capacitance measuring section, measuring a value of a capacitance of the printhead at a value of a temperature;

a memory, storing a reference value of the temperature and a reference value of the capacitance of the printhead measured at the reference value of the temperature;

a temperature computing section, computing the value of the temperature on the basis of the reference value of the capacitance, the reference value of the temperature, and the value of the capacitance;

a table which lists a plurality of values of the temperature and values of length of drive time corresponding to the plurality of values of the temperature; and a voltage selecting section, selecting a value of the length of time from among the values of the length of time listed in said table, the value of the length of time corresponding to a temperature closest to the value of the temperature and being used for driving the printhead at the value of the temperature.

* * * * *